US006578593B2

(12) United States Patent
Leonarz

(10) Patent No.: US 6,578,593 B2
(45) Date of Patent: Jun. 17, 2003

(54) HINGED FOLDING FRAMEWORK

(76) Inventor: Terry Leonarz, Winterthurer Str. 142A, Zurich (CH), 8057

( * ) Notice: Subject to any disclaimer, the term of this patent is extended or adjusted under 35 U.S.C. 154(b) by 174 days.

(21) Appl. No.: 09/755,148

(22) Filed: Jan. 8, 2001

(65) Prior Publication Data

US 2002/0124517 A1 Sep. 12, 2002

(51) Int. Cl.[7] ..... E05D 7/00; A45B 19/00; A45B 25/00

(52) U.S. Cl. ..... 135/20.1; 135/20.3; 135/143; 135/151; 135/153; 52/645; 52/646; 16/367; 403/52

(58) Field of Search ..... 135/20.1, 20.3, 135/143, 151, 153; 52/71, 645, 646, 655.1; 403/52, 53, 65, 119; 16/365, 366, 367

(56) References Cited

U.S. PATENT DOCUMENTS 614,364 A * 11/1898 Burnham ..... 135/143
4,521,998 A * 6/1985 DeLorme ..... 403/170
6,215,883 B1 * 4/2001 Leonarz ..... 381/182

FOREIGN PATENT DOCUMENTS

WO WO 89/07696 * 8/1989
WO WO 99/41943 * 8/1999

* cited by examiner

*Primary Examiner*—Robert Canfield
(74) *Attorney, Agent, or Firm*—John E. Leonarz

(57) ABSTRACT

A folding square framework which may serve as a support for a tensile canvas or membrane. This framework, which may be mounted on a fixed column or wall, may fold, around hinges set at 54.3° to the longitudinal axes of each member of the framework, at each corner, compactly together such that all four sides of the framework are rested parallel with one another, perpendicular to the plane of the unfolded structure.

5 Claims, 6 Drawing Sheets

HINGED FOLDING FRAMEWORK

CROSS REFERENCE TO RELATED APPLICATIONS

None

STATEMENT REGARDING FEDERAL SPONSORED R & D

No Federal Sponsored R & D was involved in this invention.

REFERENCE TO SEQUENCE LISTINGS, COMPUTER PROGRAMS, ETC.

None are involved in this invention.

1. Field of the Invention

The field of this invention is structural units, particularly that of folding structural units.

2. Background of the Invention

Many fold-up frames are known, but none has been found which unfolds from a parallel bundle of four frame posts automatically and co-dependently into a square, planar frame, and back again.

SUMMARY OF THE INVENTION

Four substantially identical frame posts are formed with hinge halves at each end. The hinge halves are positioned orthogonally to one another as viewed along the longitudinal axis of each frame post. Each hinge half defines a hinge-edge position for a hinge pin such that the longitudinal axis of the hinge pin forms an angle with the longitudinal axis of the frame post which is substantially 125.7°, or the complementary angle, 54.3° (plus or minus one-half degree).

When hinged together the four frame posts form a square, and, pivoting about their respective hinge axes, they fold up into a parallel bundle.

It may be noted that the frame post and hinge assembly of the present invention is somewhat similar to the structure disclosed in my copending application Ser. No. 09/022,552, International Publication No. 99/41943, in FIGS. 5a, 5b, and 5c thereof.

The foregoing description is conceptually simple and works well enough when paper models or fairly flexible materials are used to construct the folding frame of my invention (e.g. for a fold-up kite or the like). It can also be pertinent in applications which do not require folding to the parallel position. With more rigid versions of the invention, designed to carry more substantial loads, the rigid frame posts have sufficient bulk as to interfere with one another when closing to the parallel position. Therefore, to achieve the parallel configuration, practical considerations require that the hinge halves be so formed as to have the hinge pin axis offset from the longitudinal axis of the frame posts. If a frame post were constructed with aluminum tubing of one inch outside diameter, then the offset of the hinge pin axis would have to be at least one-half inch, i.e., at least half the diameter of the frame post.

Each frame post has a hinge half angled acutely to the frame post at a first end while the hinge half at the second end is angled obtusely to the frame post (or, in other words, the second end is angled acutely to the extended axis of the frame post.) In the general case, all half hinge edges (or hingepin axes) are offset from the longitudinal axis of the frame post with the offset to the inside of the folding framework (as is best observed when the four frame posts are in the parallel bundle configuration) and the hingepin axes of the hinge halves at each end of the frame posts are orthogonal to one another as viewed along the axes of the frame posts.

Since, with respect to any two nonparallel lines such as those containing the axes respectively of the frame post and of the hingepin, each of which has an infinite number of planes passing through it, exactly two such planes exist which are parallel to one another, one including the line of the first axis (e.g., frame post) and the other including the line of the second axis (e.g., hingepin). So, with respect to the two planes which are parallel to one another and which include respectively the axis of the frame post and the axis of the offset hinge-pin, the angle formed between those two axes when viewed orthogonally to the two parallel planes, is substantially 125.7°, or the complementary angle, 54.3° (plus or minus one-half degree).

The hinges are connected to form the four frame posts into a square, or as folded, into a parallel bundle. Each frame post must be either the same length with hinges at the ends, or at least have the longitudinal separation of the hinge halves be of the same length for all of the four frame posts which are to be joined together. Under an applied force and pivoting now about their respective hingepins, the frame posts rearrange themselves, and the structure which they form, from a parallel bundle, and then through an intermediate hyperbolic paraboloid phase and then into a planar square frame, which is perpendicular to the axes of the parallel bundle.

When any frame post is moved relative to its neighbor frame post, beginning from the parallel bundle configuration, in which the angle between each frame post and its pivotal neighbor is zero, the angle between each frame post and its neighbor increases such that that angle is the same at each symmetrically opposed corner of the frame for each corner at each intermediate unfolding stage. If the four respective corners of the frame are identified in series around the frame as a, b, c, and d, then a and c are symmetrically opposed and b and d are symmetrically opposed. Furthermore, a force applied at any point along any of the frame posts to change the separation of that post with respect to another post, is immediately and equally transmitted to all other frame posts in the framework. This, of course, assumes that the frame posts are constructed of a torsionally stable material, for example, aluminum tubing. Linked together as they are by the four respective hingepins, none of the four frame posts is free to move without there being a corresponding movement of each of the other frame posts.

Thus, if one corner is mounted to an external structure, and is therefore constrained against movement with respect to its corresponding hingepin axis, a coordinated force applied to drive apart the two frame posts forming the mounting corner will cause the folded frame to unfold in a uniform manner, each corner having the same angle as its symmetrically opposed corner at any given point during the excursion.

Should the mounted corner be affixed to another structure, such as a mounting column, or a building, then my frame can be made to fold or unfold adjacent to that mounting structure. If the frame is made to stretch awning canvas, the frame makes a sturdy side-mount umbrella which can be furled or unfurled as one may wish.

Minor changes may be made to the configuration especially to effect stable drive mechanisms. Slight variations may be necessary, and one such is described below with respect to the preferred embodiment.

PREFERRED EMBODIMENTS OF THE INVENTION

The preferred embodiment of my invention is a folding umbrella. Other applications may take the form of a rain catchment, an advertising platform, an exhibition display structure, a traffic signage platform, a projection screen, a cabinet door, an office partition or a folding tubular lamp. The device is made from four frame posts (of any torsion resistant material, including glass florescent-type tubes), each of which has a hinge half at each end.

However, in the preferred embodiment, an exception to the inside offset requirement mentioned above, (with respect to the parallel bundle) is introduced. Thus, at one of the two obtuse hinging corners, a spacing module is located to serve as a laterally stable mounting base. In this case hinge halves straddle outboard of the spacing module and are anchored with hinge pins through hinge bearings of hinge halves positioned on the sides of the spacing module and which are geometrically similar to the hinge halves on the respective distal obtuse framework corner. In each other corner of the structural unit the hinge halves are offset inboard of the bundle of four parallel frame posts. This affords a controlled manner of deploying the framework, for instance, by the positioning of meshing stabilizing gears concentric with mounting hingepins which are fixedly attached to their adjacent hinge halves, which allow the framework to be opened or closed in a stable and symmetrical manner. As the framework opens to a full planar square form, a stop rest structure (see FIG. 4*b*) prevents the frame posts at the mounting corner from further travel, thereby retaining the framework in a stable square configuration.

Figure 1:
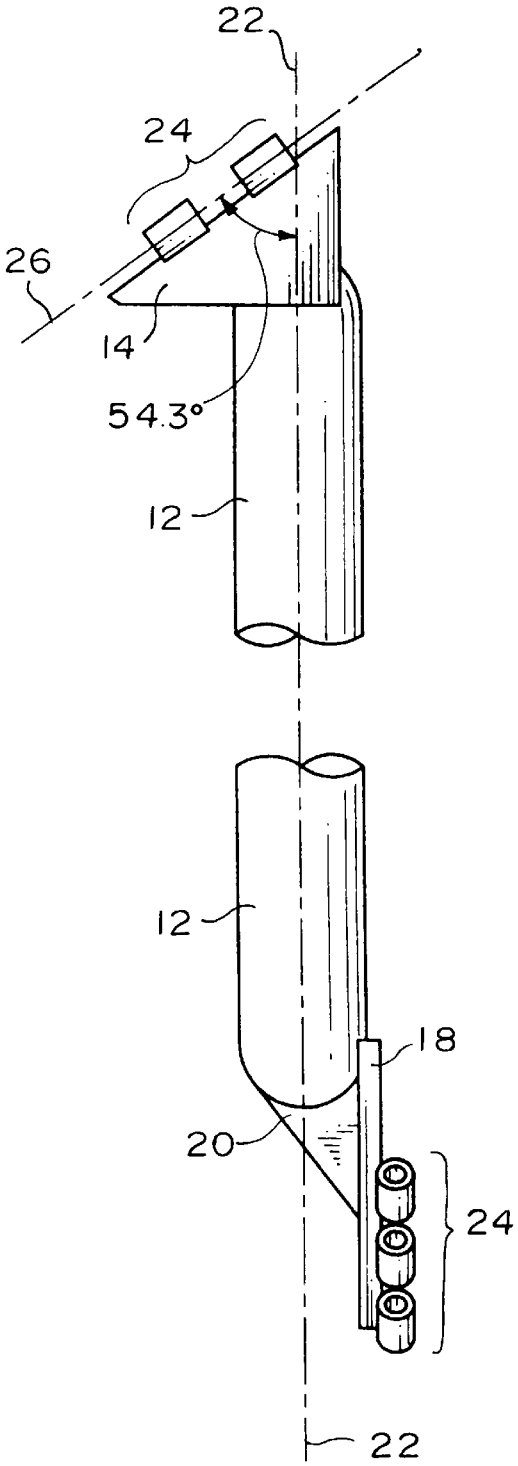
FIG. 1 shows a frame post as used in my invention with a right-offset half hinge at the bottom and a left-offset half hinge at the top.
Figure 2:
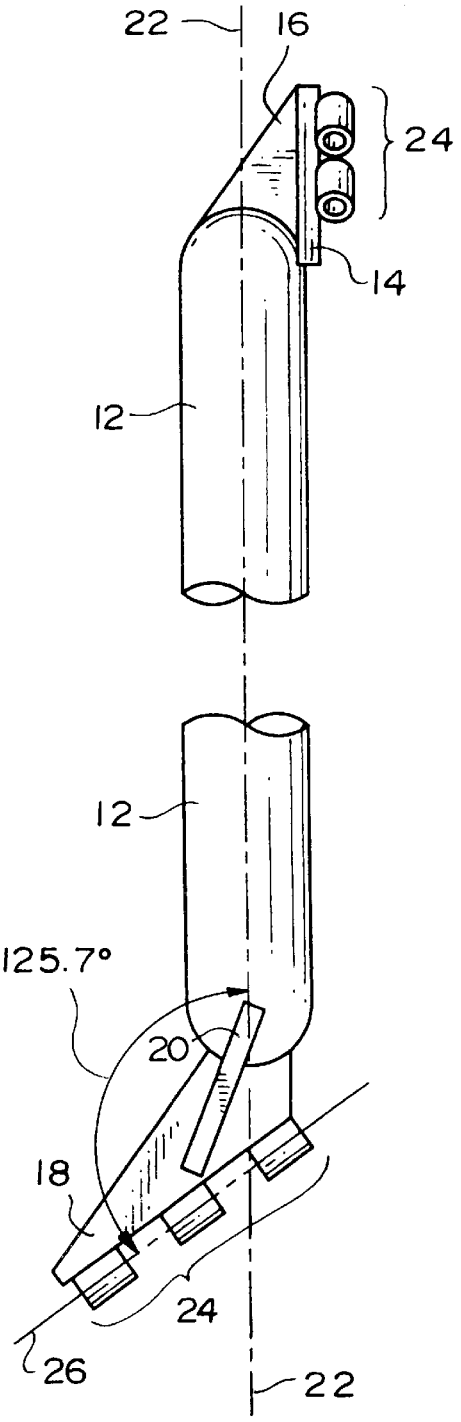
FIG. 2 shows the same frame post as in FIG. 1, rotated 90° about the longitudinal axis of the frame post.

Thus, in FIGS. 1 and 2, a frame post 12 is seen in top and a bottom sections. In the top section, an offset hinge half 14 is rigidly attached to the frame post 12 and supported by a brace 16. At the bottom, an offset half hinge 18 is rigidly attached to the frame post 12 and supported by a brace 20.

The frame post 12 has a central longitudinal axis 22 and the hinge bearings 24 define a central axis 26. As may be seen in FIG. 1, the acute angle in the top hinge half, between the hinge axis 26 and the frame post axis 22, is substantially 54.3°. In FIG. 2 it may be seen that the hinge angle is the complementary obtuse angle of substantially 125.7°.

Figure 3:
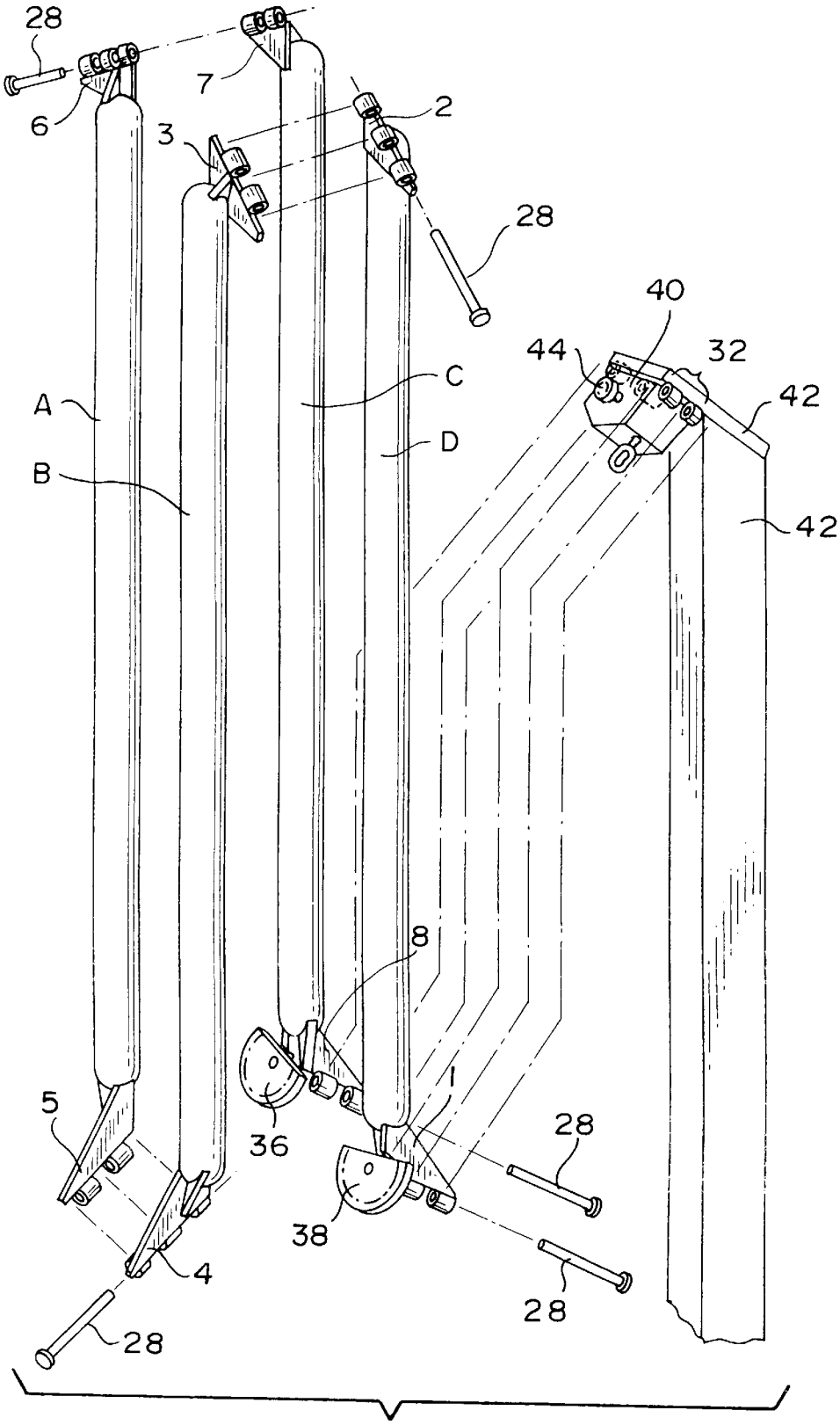
FIG. 3 shows four frame posts with half hinges in place ready for assembly into the parallel configuration. Also appearing is part of a mounting column with gearbox to which two frame posts are to be attached.

In FIG. 3 are shown a collection of four frame posts, A, B, C, and D, with half hinge arrangements along the lines of that shown in FIG. 1 and FIG. 2, arranged in parallel, and having dotted lines to show which hinge half is to be meshed with which other hinge half for the insertion of hinge pins 28, which are secured with conventional fastening means.

Seen from the base, as shown in the parallel configuration, in FIG. 3, frame posts A, B, C, and D are arrayed as specified in the table below. Frame post D has the frame post position which is to the left and proximal to the base. Counting from the position of the base it has first (lower) and second (higher) half hinges. The first hinge half (1) on frame post D is to be hinged to the base and the angle of its hingepin axis to the axis of frame post D is obtuse (125.7°). Its offset, viewed from the base, is to the left of the axis of the frame post D, and it is outboard of the framework. The second (higher) hinge half (2) is to be hinged to hinge half (3), which is the first (higher) hinge half on frame post B. The angle of the hingepin axis of hinge (2–3) to the axis of frame posts D and B is acute (54.3°). The offset of hinge half (2), viewed from the base, is away from the base, while the offset of hinge half 3 is towards the base.

Frame post B has the frame post position which is to the left and distal to the base. Counting from the position of hinge half (2), it has first (higher) and second (lower) half hinges. The first hinge half (3) on frame post B, as mentioned above, is hinged to hinge half (2). The second (lower) hinge half (4) is to be hinged to hinge half (5), which is the second (lower) hinge half on frame post A. The angle of the hingepin axis of hinge (4–5) to the axis of frame posts B and A is obtuse. Its offsets, viewed from the base, is right for (4), and left for (5).

Frame post A has the frame post position which is to the right and distal from the base. Counting from the position of hinge half (4) it has first (lower) and second (higher) half hinges. The first hinge half (5) on frame post A, as mentioned above, is hinged to hinge half (4). The second (higher) hinge half (6) is hinged to hinge half (7), which is the first (higher) hinge half on frame post C. The angle of the hingepin axis of hinge (6–7) to the axis of frame posts A and C is acute (54.3°). Its offsets, viewed from the base are towards the base for (6) and away from the base for (7).

Frame post C has the frame post position which is to the right and proximal to the base. Counting from the position of hinge half (6) it has first (higher) and second (lower) half hinges. The first hinge half (7) on frame post C, as mentioned above, is hinged to hinge half (6). The second (lower) hinge half (8) is to be hinged to the base. The angle of the hingepin axis of hinge half (8) to the axis of frame post C is obtuse. Its offset, viewed from the base, is to the right of the axis of the frame post C, and it is outboard of the framework.

The relationships of all of the half hinges on each of the frame posts is given in the table below.

| Half hinge | No. | Hinges to | Frame post position | Angle | Offset | Orientation |
|---|---|---|---|---|---|---|
| D, first | 1 | base | proximal left | obtuse | left | outboard |
| D, | 2 | 3 | proximal | acute | away | inboard |

-continued

| Half hinge | No. | Hinges to | Frame post position | Angle | Offset | Orientation |
|---|---|---|---|---|---|---|
| second | | | left | | | |
| B, first | 3 | 2 | distal, left | acute | toward | inboard |
| B, second | 4 | 5 | distal, left | obtuse | right | inboard |
| A, first | 5 | 4 | distal, right | obtuse | left | inboard |
| A, second | 6 | 7 | distal, right | acute | toward | inboard |
| C, first | 7 | 6 | proximal right | acute | away | inboard |
| C, second | 8 | base | proximal right | obtuse | right | outboard |

For purposes of controlling the opening and closing of the structural device of my invention, frame posts C and D are provided with special half hinges, (1) and (8), which have rigidly attached stabilizing gears concentric to each hinge pin axis. Half hinge (1) mates with half hinge (32) which is welded to a gearbox 40, which is rigidly mounted to a support 42. Half hinge (8) mates with a half hinge which is symmetrical to half hinge (32), and which is out of sight behind the gearbox 40. When assembled, the stabilizing gears 36 and 38 mesh together, to be driven by the pinion 44.

Figure 4A:
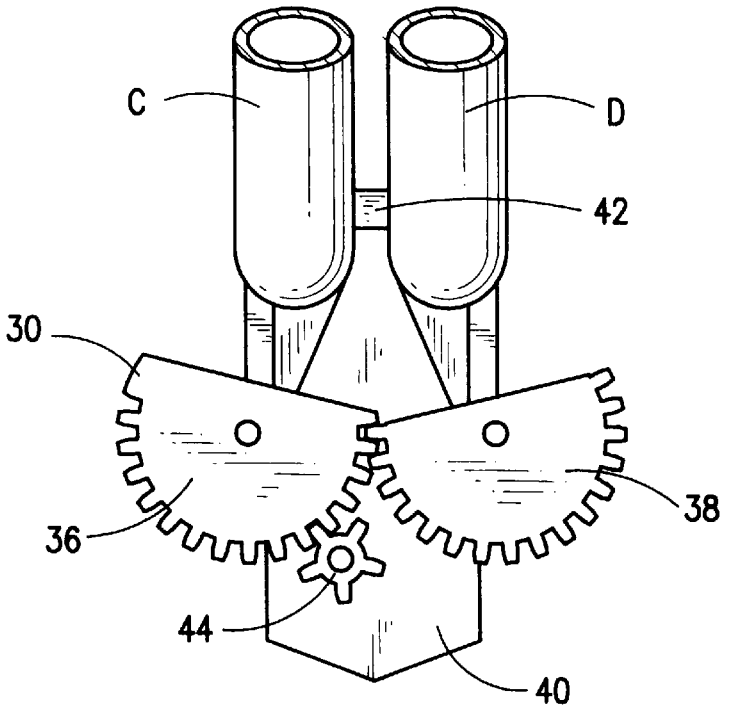
FIG. 4*a* is an elevation of the stabilizing gears and pinion gear of a fully assembled structural unit in the closed (parallel) configuration, with only the two frame posts which are proximate to the mounting column shown.
Figure 4B:
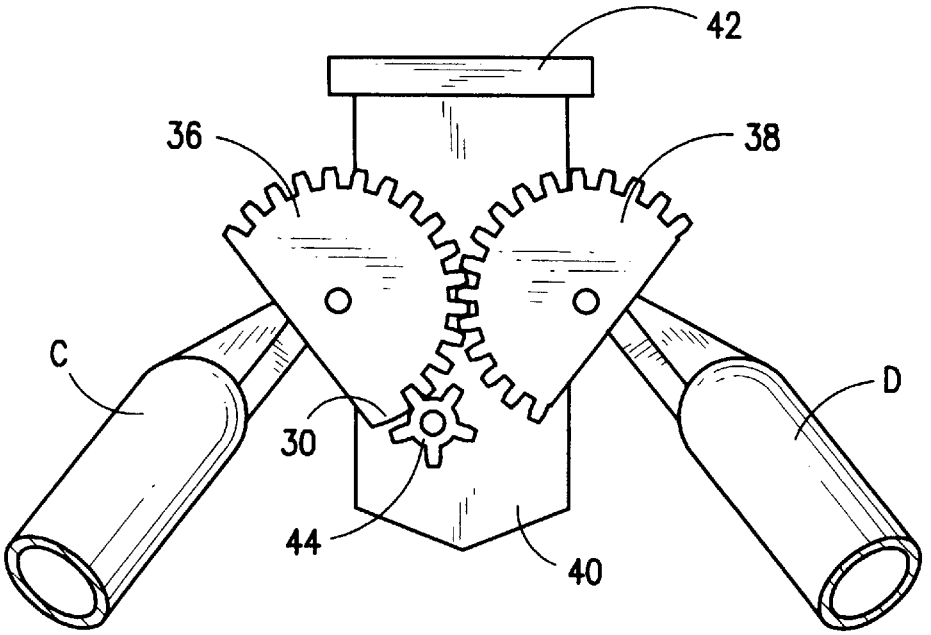
FIG. 4*b* shows the same assembly as in FIG. 4*a* in the fully opened (square) configuration.

FIG. 4*a* shows the position of the stabilizing gears 36, 38 when the frame posts C and D (as well as A and B, not shown) are parallel. FIG. 4*b* shows the position of the gears in the full open position, held in a stable configuration when the stop 30 comes to rest against the pinion 44.

Figure 5:
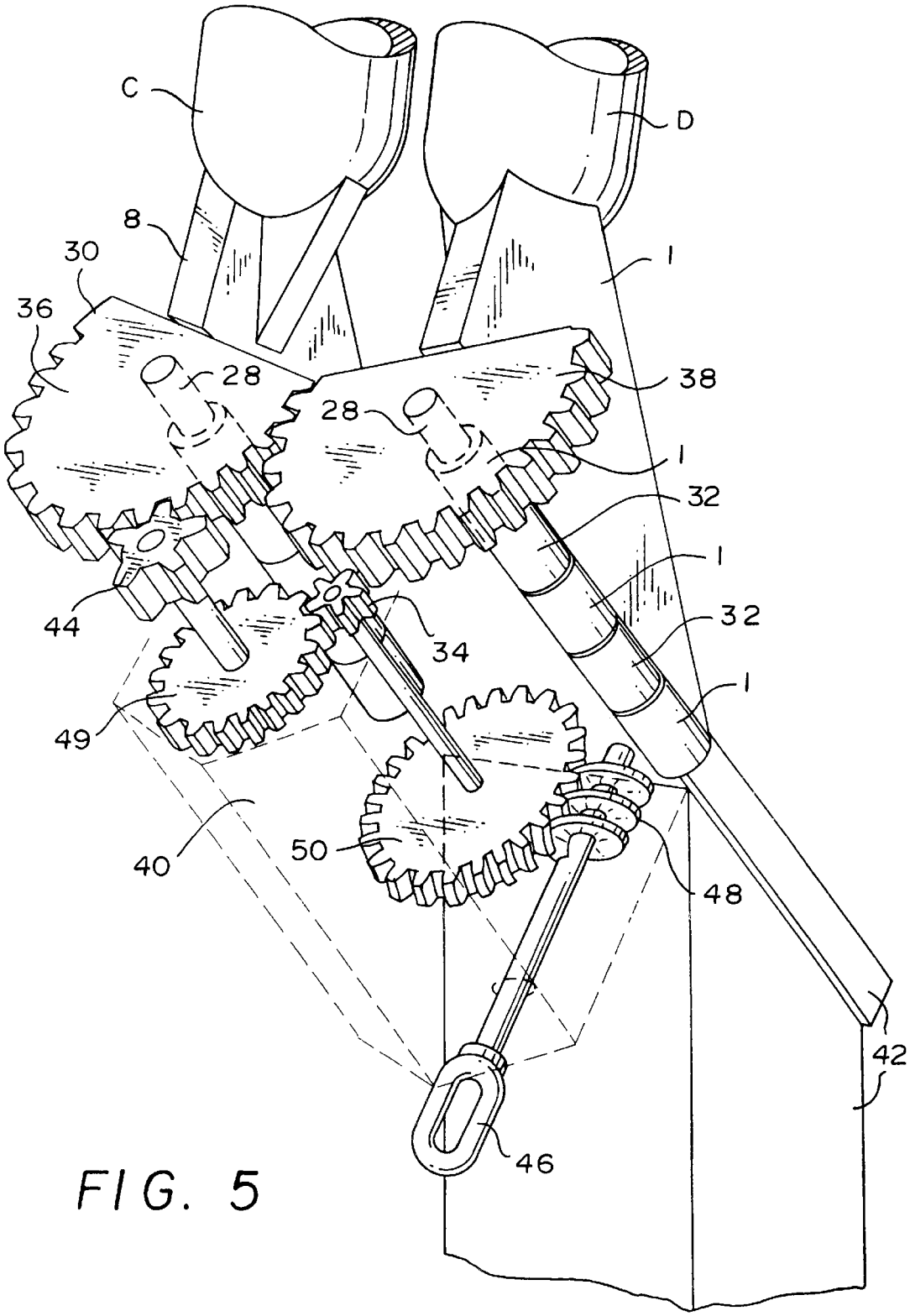
FIG. 5 shows the gear box mechanism (driving gears and coupling ring) with frame posts and stabilizing gears mounted on the gear box assembly.

It may be seen in FIG. 5 that the gearbox 40 is mounted to a support 42 which may be a mounting column stoutly anchored in the ground or a building, or some form of base structure. It may be further seen that the hinge bearings 24 of hinge halves 1 and 8, will be assembled together from the bearings on the frame posts C and D onto the bearings 32 present on gearbox 40. A worm 48 shown in FIG. 5 is driven by turns introduced through the coupling ring 46. The worm 48 drives against intermediate worm gear 50, which shares the shaft of step-down pinion gear 34 which drives intermediate step down gear 49, which shares the shaft of pinion 44, which drives the stabilizing gears 36 and 38 as previously discussed.

By providing the gear box 40 through which are journaled the two hinge pins 28, a stabilizing base is formed by the two stabilizing gears 36, 38, which are of equal radius and gear teeth configurations to one another The gear box 40, rigidly attached to a mounting post 42, or building 42, or some structure 42, which is a fixed reference to the surrounding environment (e.g., ground, wall, vehicle, vessel, etc.) provides the defining base of support of the folding framework structure. As the stabilizing gears 36, 38 (FIGS. 4*a*, 4*b*) rotate against one another, this base remains supportively constant in space relative to its surrounding environment. The base therefore provides a geometric constancy with respect to which the frame folds and unfolds.

Each stabilizing gear 36, 38 is fixed to its respective hingepin 28, and the hingepin 28 is fixed to its corresponding framework member c or d. Thus, the rotation of the respective meshed gears 36 and 38, produces a symmetrical movement of the entire structure, folding or unfolding, which is related to its base and surrounding environment.

While meshed, neither gear 36, 38 can rotate freely without reference to the rotation speed of the other. Thus, while meshed, the stabilizing gears coordinate respective excursions of the frame members c and d (FIG. 3) so that the frame members' excursions are constrained relative to the base and the movements of the framework are therefore made in spatial relation to the surrounding environment. It is true that a force applied to a frame member to drive that frame member relative to another of the four frame members, will be transmitted throughout the framework to effect equal and opposite movements at the symmetrical corners, but if the framework is to fold/unfold in spatial relation to its environment then some means must be provided (here effected by the gear box 40 and meshed journaled stabilizing gears 36, 38) for coordinating movement of the framework relative to its environment.

Figure 6:
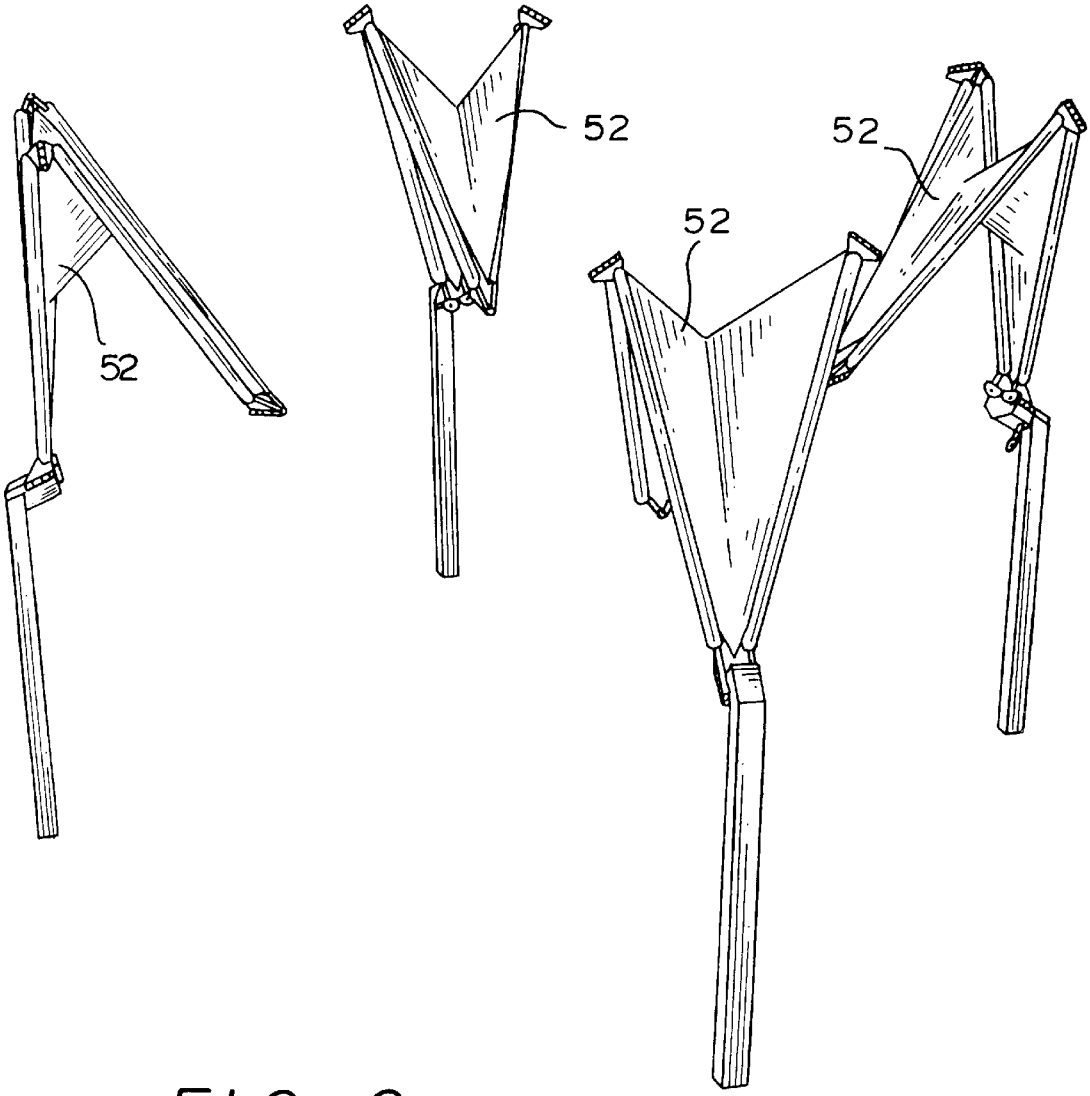
FIG. 6 shows an array of four folding frames, or structural units, each mounted on a support column, and each at the same stage in the process of unfurling.

In FIG. 6 are shown four folding frameworks configured as side-mount umbrellas, sunshades, rain catchments, or the like, each with a membrane 52 installed. As illustrated in FIG. 6, the frameworks have opened to about 25% of the fully open configuration. Finally, in FIG. 7, the frameworks have opened to their fully open configuration. If mounted in the arrangement shown in FIG. 7, the distal corners, adjacent one another in the center of the overall four frame structure, of the respective frames, may be fitted with connecting devices to attach each frame to its neighbor so as to maximize stability of the assemblage.

Figure 7:
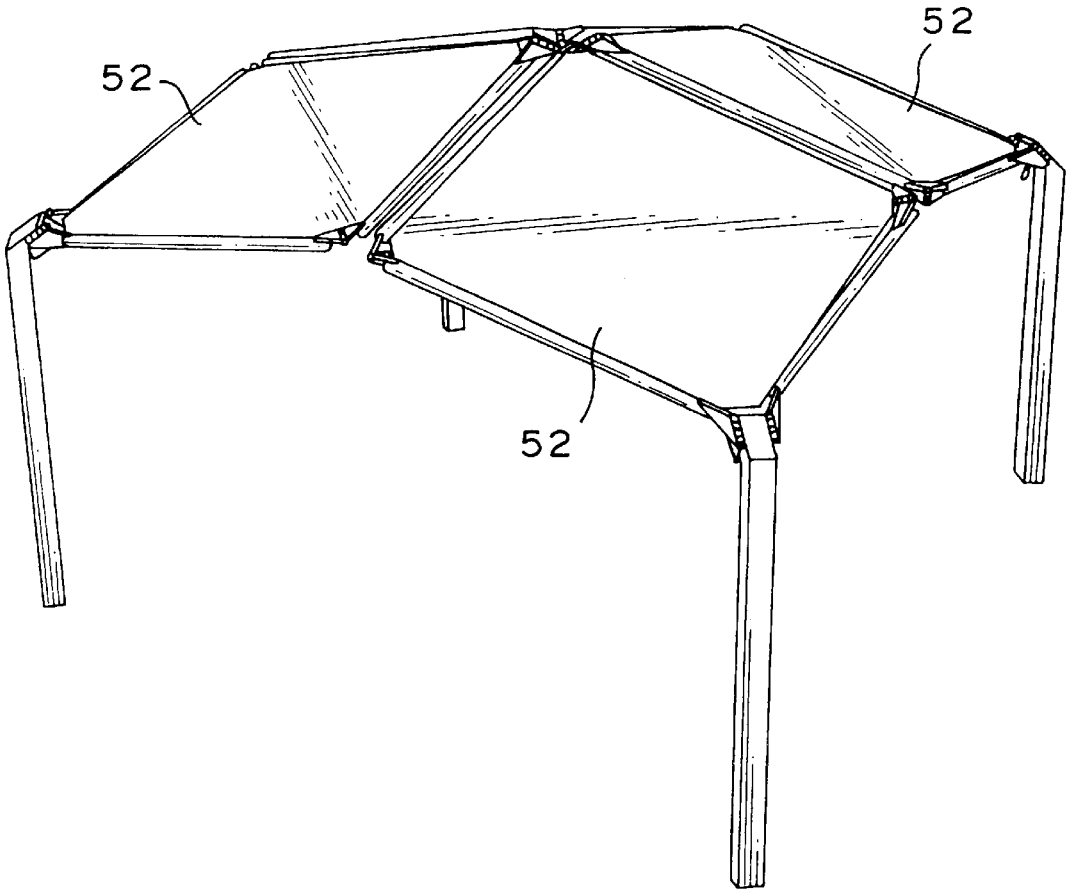
FIG. 7 shows the fully opened frames, or structural units, previously shown in FIG. 6. Note that the position of the four structural units is such that all four units meet at the center of a square, each corner of which defines the position of the mounting columns.

In addition to the configuration of FIGS. 6 and 7, wherein four folding framework side-mounted umbrella structures are mounted on four different bases so as to provide an over-arching square cover free of mounting obstructions beneath, it is also possible to mount four folding framework side-mounted umbrellas on a single post (e.g., North-South-East-West), thereby enabling coverage of the same square area as the four-post mount, but with the mounting post being central to the covered area. By multiplying the numbers of side-mounted umbrellas adjacent one another, it is possible to cover an infinitely large surface area, seamlessly, with a matrix of folding umbrellas of the types provided by my invention.

I claim:

1. A hinge half comprising

Frame post means, said frame post means defining a longitudinal axis, and

Said frame post means having a width w, and

Hinge bearing means rigidly connected to said frame post means, said hinge bearing means defining a longitudinal axis, and Said frame post, means axis and said hinge bearing means axis being disposed at an angle of substantially 54.3° to one another when viewed along an axis which is orthogonal to offset parallel planes containing respectively said frame post means axis and said hinge bearing means axis, said offset parallel planes being offset from one another by a distance of at least half of said width w.

2. A framework member comprising frame post means, with said frame post means having two of the hinge halves of claim 1, said two hinge halves being disposed orthogonally to one another when viewed along said frame post axis.

3. A folding framework comprising four of the framework members of claim 2, connected together through cooperative hinge bearings, and forming a square figure when open and which folds around lines defined by said hinge bearings.

4. A folding framework in a spatial environment, comprising:

four of the framework members of claim 2, wherein a first said framework member and a second said framework member are obtusely hinged, each at their respective proximal ends at separated positions on a base, movement coordinating means connected to said base, said movement coordinating means being also connected to said first framework member and also to said second framework member for coordinating spatial movement of said first framework member and said second framework member relative to said spatial environment, said first framework member being acutely hinged at its distal end to the proximal end of a third said framework member, said second framework member being acutely hinged at its distal end to the proximal end of a fourth said framework member, and the said third framework member being obtusely hinged at its distal end with the distal end of the fourth said framework member.

5. Folding frame comprising:

Four members, each of said members having two half hinges disposed thereon, said two half hinges being separated, longitudinally on said member, by a distance d, said distance d being the same on each of said four members, Each said member having a width w, Said half hinges having hinging axes disposed respectively at an angle of substantially 54.3° from the longitudinal axes of the member to which they are attached, said angle of substantially 54.3° being measured when viewed along a line orthogonal to parallel planes containing respectively said longitudinal axis of said half hinge hinging axis and said longitudinal axis of said member, said parallel planes being offset from one another by a distance of at lease half of said width w, and said half hinges on each of said members being disposed orthogonally to one another when viewed along the longitudinal axes of said members, and A first half hinge on a first member being hinged to a first half hinge on a second member, A second half hinge on said second member being hinged to a first half hinge on a third member, A second half hinge on said third member being hinged to a first half hinge on a fourth member, and A second half hinge on said fourth member being hinged to a second half hinge on said first member.

* * * * *